United States Patent [19]

Watanabe

[11] Patent Number: 4,733,590

[45] Date of Patent: Mar. 29, 1988

[54] KEYBOARD SWITCH APPARATUS FOR ELECTRONIC MUSICAL INSTRUMENT

[75] Inventor: Keisuke Watanabe, Shizuoka, Japan

[73] Assignee: Nippon Gakki Seizo Kabushiki Kaisha, Hamamatsu, Japan

[21] Appl. No.: 800,559

[22] Filed: Nov. 21, 1985

[30] Foreign Application Priority Data

Dec. 4, 1984 [JP] Japan ..... 59-255097

[51] Int. Cl.[4] ..... G10H 1/34

[52] U.S. Cl. ..... 84/1.1; 84/DIG. 7; 200/5 A

[58] Field of Search ..... 84/1.1, DIG. 7; 200/5 A; 350/365 R

[56] References Cited

U.S. PATENT DOCUMENTS

| | | | |
|---|---|---|---|
| 3,965,789 | 6/1976 | Pearlman | 84/DIG. 7 |
| 3,995,126 | 11/1976 | Larson | 200/5 A |
| 4,052,581 | 10/1977 | Matsui . | |
| 4,160,400 | 7/1979 | Schrecongost | 84/1.1 X |
| 4,268,815 | 5/1981 | Evantoff et al. | 84/DIG. 7 |
| 4,506,581 | 3/1985 | Sunada | 84/1.1 |
| 4,615,252 | 10/1986 | Yamauchi et al. | 84/1.1 |
| 4,628,785 | 12/1986 | Buchla | 84/1.1 |
| 4,628,786 | 12/1986 | Buchla | 84/1.1 |
| 4,668,843 | 5/1987 | Watanabe et al. | 200/5 A |

*Primary Examiner*—Stanley J. Witkowski

*Attorney, Agent, or Firm*—Blakely, Sokoloff, Taylor & Zafman

[57] ABSTRACT

A keyboard switch apparatus for an electronic musical instrument has first, second and third layers, and first and second switches. The second layer has elasticity and is separated from the first layer. The third layer has elasticity and is inserted between the first and second layers at a distance therefrom. The first switch consists of conductors respectively formed on opposite surfaces of the second and third layers. The second switch consists of conductors respectively formed on opposite surfaces of the first and third layers. The second and third layers are sequentially urged and deformed by an actuator interlocked with key depression. The first and second switches are sequentially closed. A time requred for closing the first switch is different from that for closing the second switch. The closure time difference corresponds to a key depression speed, which is used to generate a signal corresponding to the depression speed, and a musical tone signal corresponding to the depression speed.

13 Claims, 12 Drawing Figures

KEYBOARD SWITCH APPARATUS FOR ELECTRONIC MUSICAL INSTRUMENT

BACKGROUND OF THE INVENTION

The present invention relates to a keyboard switch apparatus for an electronic musical instrument.

In an electronic musical instrument such as an electronic organ, it is well-known to use a keyboard switch not only for providing key code data of a depressed key but also for detecting touch response such as a key depression timing (key on timing), a depression speed or pressure and a key off timing so as to enrich musical expressions. A typical example of a key switch of this type is described in U.S. Pat. No. 4,052,581. This keyboard switch is called a leaf switch. A pair of opposite stationary leaves are fixed to a leaf holder while a spring force is acting on the leaf switches which come close to each other. A movable leaf is fixed to the leaf holder and is located between the stationary leaves. A spacer is disposed between the stationary leaves. One of the stationary leaves is normally in contact with the movable leaf to constitute a normally closed switch, and the other of the stationary leaves is normally separated from the movable leaf to constitute a normally open switch.

When an actuator urges the movable leaf upon depression of a key, the normally closed switch is opened, and a key on signal concerning a depressed key or an electrical signal concerning a key code is generated. By measuring a period from a time at which the movable leaf is separated from the stationary leaf of the normally closed switch to a time at which it is brought into contact with the stationary leaf of the normally open switch, an electrical signal representing a key depression speed can be generated.

In a conventional keyboard switch apparatus of this type, although a distance between the free ends of the stationary leaves is kept substantially constant by the spacer, it is difficult to mount the spacer at a position substantially midpoint between the free and fixed ends of the stationary leaves. Furthermore, the stationary leaves are bent at many positions, so that a distance between the stationary leaves tends to vary. In addition, since the two stationary leaves and the movable leaf are held by a single leaf holder, assembly and replacement are cumbersome. The mounting operation of the spacer is time-consuming, resulting in high cost. When dust is attached to the contacts of the leaves, contact errors occur and degrade reliability and durability of the switch.

SUMMARY OF THE INVENTION

It is, therefore, a principal object of the present invention to provide a simple keyboard switch apparatus for an electronic musical instrument which has small switching variations.

It is another object of the present invention to provide a keyboard switch apparatus for an electronic musical instrument which has high reliability and durability.

It is still another object of the present invention to provide a keyboard switch apparatus for an electronic musical instrument which can be easily assembled as compared with a conventional keyboard switch apparatus.

In order to achieve the above and other objects of the present invention, there is provided a keyboard switch apparatus for an electronic musical instrument, comprising: a first layer; a second layer disposed at a distance from the first layer and having elasticity; a third layer disposed between the first and second layers at a distance therefrom and having elasticity; a first switch consisting of conductors respectively formed on opposite surfaces of the second and third layers; and a second switch consisting of conductors respectively formed on opposite surfaces of the first and third layers, the second and third layers being sequentially deformed by an actuator interlocked with a key depression to sequentially close the first and second switches, the first switch having a closing timing different from that of the second switch.

DESCRIPTION OF THE PREFERRED EMBODIMENTS

The present invention will be described in detail with reference to preferred embodiments in conjunction with the accompanying drawings.

Figure 1:
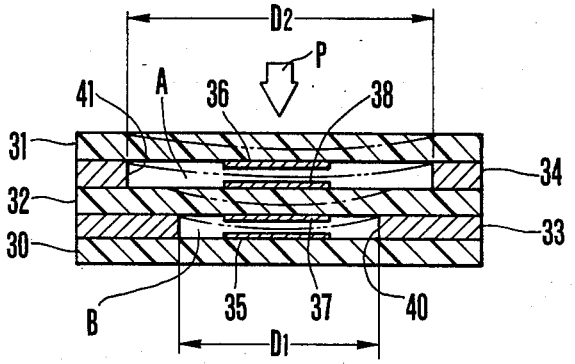
FIG. 1 is a sectional view of a keyboard switch apparatus according to an embodiment of the present invention.
Figure 2:
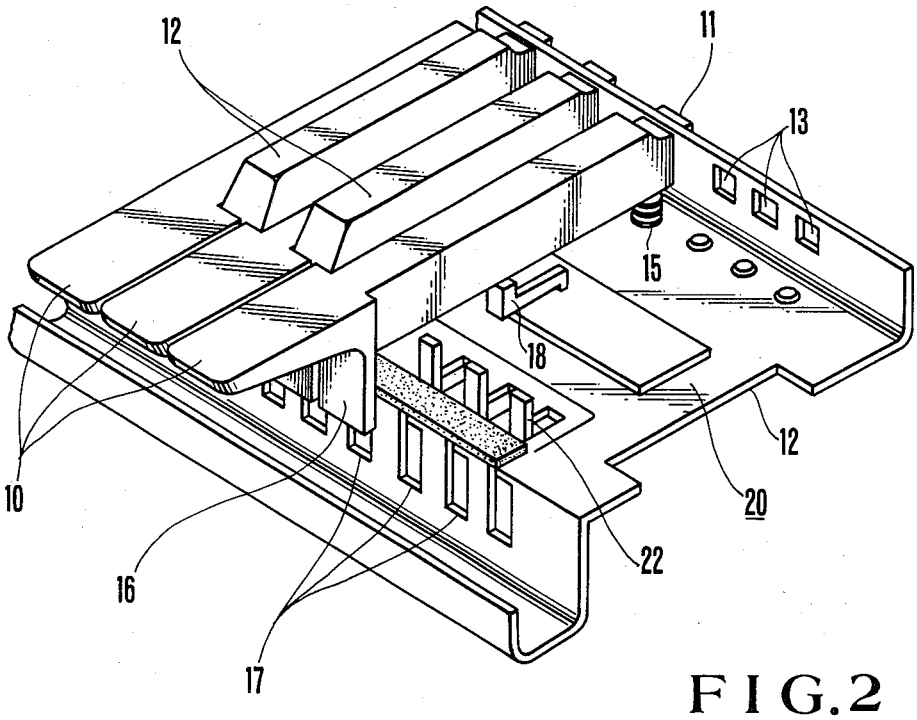
FIG. 2 is a perspective view of a keyboard unit.

FIG. 1 is a sectional view of a keyboard switch apparatus according to an embodiment of the present invention, and FIG. 2 is a perspective view of a keyboard unit.

Referring to FIG. 2, each white key 10 can be vertically pivoted on a keyboard frame 12 about an engaging projection 11 which extends from the rear end face thereof by engaging the projection 11 with a corresponding through hole 13 formed at the rear end portion of the keyboard frame 12. Each white key 10 is always biased by a corresponding return spring 15 upward. The return spring 15 is arranged on the upper surface of the rear end portion of the keyboard frame 12. A hook-like stopper 16 integrally suspends from the white key 1 on the lower surface of the front end portion thereof. The lower end of the stopper 16 is engaged with a corresponding through hole 17 formed in the front end portion of the keyboard frame 12 and defines the pivotal angle of the white key 10 along the vertical direction. A crank-like actuator 18 is integrally formed with each white key 10 below the intermediate portion of the lower surface thereof. A keyboard switch apparatus 20 (to be described later with reference to FIG. 1) is arranged for each actuator 18 on the keyboard frame 12. The keyboard switch apparatus 20 may comprise a single apparatus for all keys consisting of white and black keys 10 and 21 or may be divided into parts for treble, mean and bass, or parts in accordance with desired units. The keyboard switch apparatus 20 is designed to detect depression data such as a striking speed when the actuator 18 is moved downward upon depression of a specific key and a corresponding musical tone signal is generated.

The black key 21 has the same structure as that of the white key 10. Each key guide 22 is formed by a raised member which is fitted under the white or black key 21, thereby preventing key movement along the right-and-left direction.

The arrangement of the keyboard switch apparatus 20 will be described in detail with reference to FIG. 1. The keyboard switch apparatus 20 comprises first, second and third layers 30, 31 and 32, first and second spacer members 33 and 34 respectively inserted between the first and third layers 30 and 32 and between the second and third layers 31 and 32, and conductors 35 to 38 formed such that the conductors 35 and 37 are formed on the opposite surfaces of the first and third layers 30 and 32 and the conductors 36 and 38 are formed on the opposite surfaces of the second and third layers 31 and 32. The conductors 36 and 38 constitute a first normally open switch A, and the conductors 35 and 37 constitute a second normally open switch B.

The first, second and third layers 30, 31 and 32 comprise plastic sheets of polyester, polyimide or the like, respectively, and have elasticity. However, since the first layer 30 as the lowermost layer is directly disposed on the keyboard frame 12, the layer 30 need not have elasticity. At least the second and second layers 31 and 32 have an identical thickness.

The first and second spacer members 33 and 34 comprise plastic sheets of polyester or the like and have openings 40 and 41, respectively. The openings 40 and 41 allow elastic deformation of the second and third layers 31 and 32 so as to bring the conductors 35 and 37 into contact with the conductors 36 and 38, respectively. A thickness of the first spacer member 33 is the same as that of the second spacer member 34. A width D1 of the opening 40 is smaller than a width D2 of the opening 41.

The conductors 35 to 38 are arranged in each actuator 18 for the key. The conductors 35 and 38 are formed by pattern printing, and the conductors 36 and 37 are formed by carbon printing.

With the arrangement described above, when the given actuator 18 urges the central portion of the upper surface of the second layer 31 upon depression of the corresponding key, a portion of the layer 31 which corresponds to the opening 41 is elastically deformed, as indicated by the alternate long and short dashed line of FIG. 1, to bring the conductor 36 into contact with the conductor 38, and the first normally open switch A is closed. When the actuator 18 is then further moved downward, the third layer 32 is elastically deformed downward to close the second normally open switch B. The times for closing the normal open switches A and B are short when a key depression speed is high. Otherwise, the closing times are prolonged. When a difference between the closing times of the normally open switches A and B is measured, key depression data can be detected to perform touch response control of a produced tone.

A circuit of an electronic musical instrument adapting the keyboard switch apparatus described above will be described with reference to FIG. 3 together with its operation.

Figure 3:
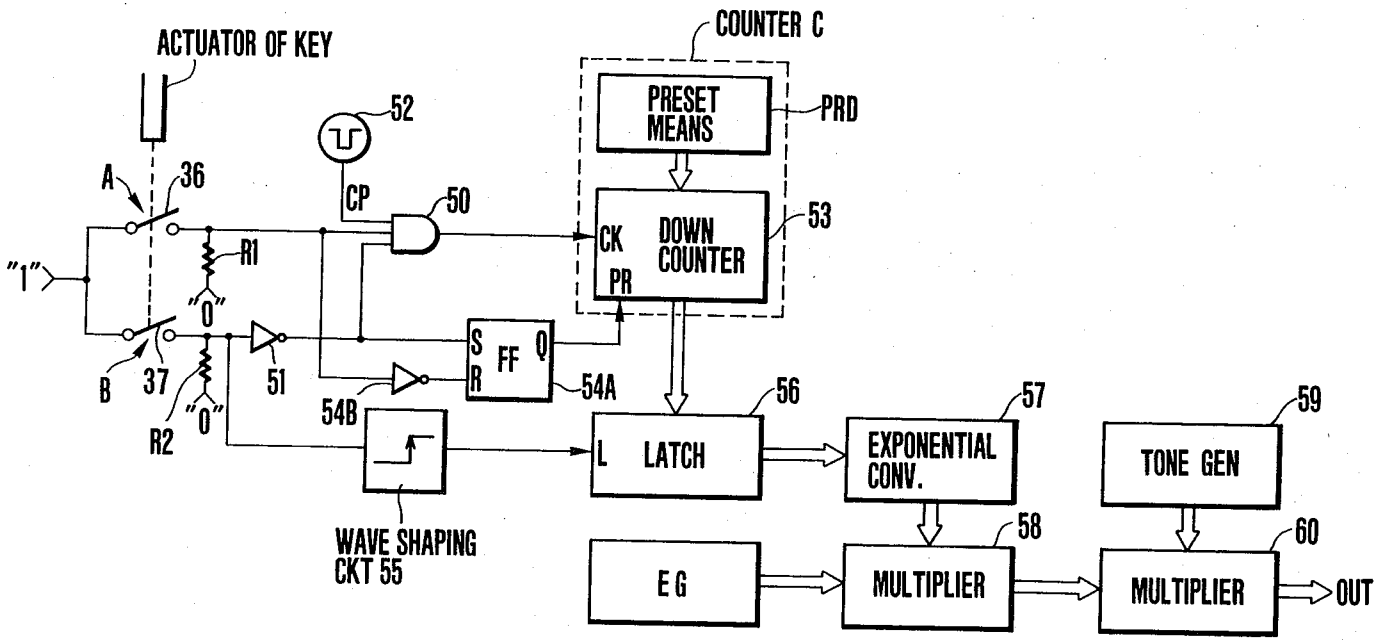
FIG. 3 is a block diagram of an electronic musical instrument using the keyboard switch apparatus shown in FIG. 1.

Referring to FIG. 3, stationary contacts of the first and second normally open switches A and B are connected to "0" signal sources through resistors R1 and R2, respectively. The movable contacts (i.e., the conductors 36 and 37) of the switches A and B are commonly connected to an "1" signal source. The stationary contact of the first normally open switch A is connected to an input terminal of a 3-input AND gate 50. The stationary contact of the second normally open switch B is connected to another input terminal of the AND gate 50 through an inverter 51. When the second normally open switch B is not closed, the inverter 51 supplies an output of logic "1" to the corresponding input terminal of the AND gate 50. Since the first and second normally open switches A and B are normally open, outputs therefrom are supplied as gate control input signals of logic "0" and "1" to the AND gate 50. The AND gate 50 is disabled and does not supply to a counter C a clock pulse CP supplied as an output signal from a clock pulse source 52.

When a player depresses a key, the actuator interlocked with this key is moved downward to firstly close the first normally open switch A. Both the gate control inputs to the AND gate 50 are set at logic "1". The clock pulse CP from the clock pulse source 52 is thus gated to the counter C through the AND gate 50. The counter C comprises a preset means PR and a down counter 53 preset by the preset means PR. The down counter 53 has a preset control terminal PR for receiving the preset input and a clock terminal CK for receiving an ANDed output (i.e., the clock pulse CP) from the AND gate 50. The down counter 53 is decremented by one from the value preset by the preset means every time the clock pulse CP is supplied thereto.

When the player further depresses the key, the second normally open switch B is subsequently closed while the first normally open switch A is closed, and the output from the inverter 51 is set at logic "0". The gate control inputs to the AND gate 50 are set at logic "1" and "0", so that the clock pulse CP is no longer gated through the AND gate 50. As a result, the down counter 53 is stopped. When the normally open switch B is closed, a change in logical level from logic "0" to logic "1" at the output side thereof is detected, and a waveshaping circuit 55 is started. The count of the down counter 53 is latched by a latch 56. When the player finishes depressing the key and releases the key, the second normally open switch B is opened, and the inverter 51 generates the output of logic "1" again. An R-S flip-flop 54A is arranged at the output side of the inverter 51, so that the output of logic "1" from the inverter 51 sets the flip-flop 54A. The flip-flop 54A thus generates a Q output. As a result, the preset value is set by the preset means PR in the down counter 53 at the leading edge of the Q output of the flip-flop 54A. When the key is further moved upward, the first normally open switch A is opened. In this state, the signal of logic "1" is supplied to the reset terminal of the flip-flop 54A through an inverter 54B, so that the flip-flop 54A is reset. The preset value is already set in the down counter 53 for the next key depression. When the key is depressed again, the same operation as described above is repeated.

An output from the latch 56 is supplied to an exponential converter 57. The exponential converter 57 converts the output of the latch 56 to a coefficient corresponding to a key depression speed. The coefficient is multiplied by a multiplier 58 with an envelope waveshape from an envelope generator EG. An envelope signal is multiplied by a multiplier 60 with an output signal from a tone generator 59 to produce a musical tone signal.

Figure 4:
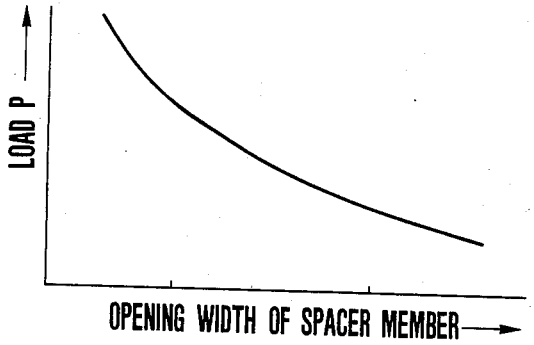
FIG. 4 is a graph showing the relationship between the load and the opening width of a spacer member.

When the player depresses a key, a time from which the actuator 18 interlocked with the depressed key urges the second layer 31 until the first normally open switch A is closed is different from that until the second normally open switch is closed. When the second layer 31 has the same thickness and mechanical characteristics as the third layer 32, and the first and second spacer members 33 and 34 have the same thickness, the relationship between a make load P of the normally open switch A or B and the opening width of the spacer member 33 or 34 is exponentially changed, as shown in FIG. 4. When the load P is determined, the opening width is solely given.

In this embodiment, since the width D1 of the first spacer member 33 is smaller than the width D2 of the second spacer member 34, the third layer 32 requires a load larger than that required by the second layer 31 when they are deformed. When the load P is predetermined, a time for deforming the third layer 32 is longer than that for deforming the second layer 31. Therefore, the times required for closing the first and second normally open switches A and B are different from each other. As a result, the two normally open switches A and B constitute a 2-make differential switch.

When the time required for closing the second normally open switch B is longer than that for the first normally open switch A, the number of clock pulses CP counted by the down counter 53 is increased corresponding to the time difference. Although the distances between the sheet-like conductors 36 and 38 and between the sheet-like conductors 35 and 37 are short, the proper closing times can be accurately measured in accordance with the key depression speed.

When the actuator 18 has a crank-like shape, as shown in FIG. 2, the actuator 18 is elastically deformed upward to damp the reaction force upon depression of the keyboard switch apparatus 20, thereby eliminating an adverse effect of key touch.

Figure 5A:
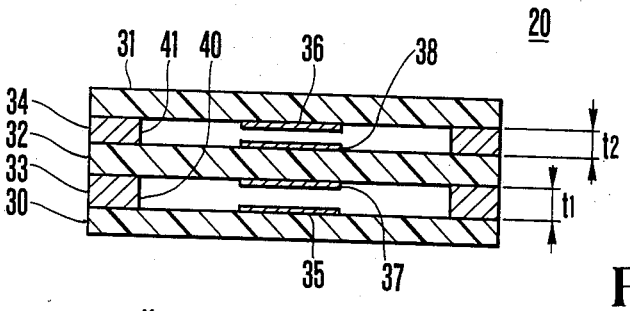
FIGS. 5A, 5B and 5C are sectional views of keyboard switch apparatuses according to other embodiments of the present invention, respectively.
Figure 5B:
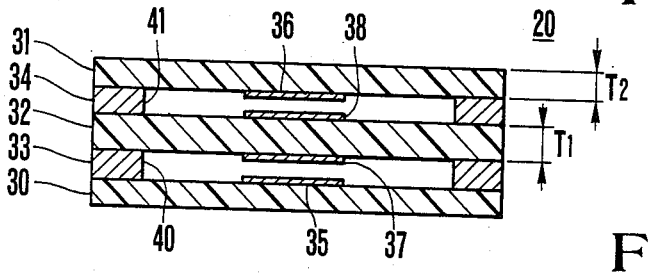
Figure 5C:
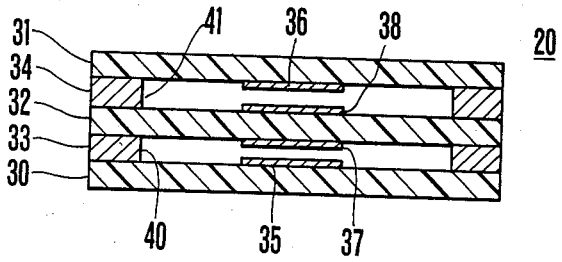

FIGS. 5A, 5B and 5C are sectional views of keyboard switch apparatuses according to other embodiments of the present invention, respectively. In these embodiments, the time for closing the second normally open switch B is longer than that for closing the first normally open switch A in accordance with techniques without changing the opening widths of FIG. 1. In the apparatus of FIG. 5A, a thickness t1 of a first spacer member 33 is larger than a thickness t2 of a second spacer member 34. In the apparatus of FIG. 5B, a thickness T1 of a third layer 32 is larger than a thickness T2 of a second layer 31. In the apparatus of FIG. 5C, a material of a third layer 32 is harder or has a medium of elasticity larger than that of a second layer 31. It should be noted that the thicknesses and mechanical characteristics of the second and third layers 31 and 32 are identical in FIG. 5A, that the thicknesses of the second and third layers 31 and 32 are identical in FIG. 5C, and that the thicknesses of the first and second spacer members 33 and 34 are identical in FIGS. 5B and 5C.

Figure 6:
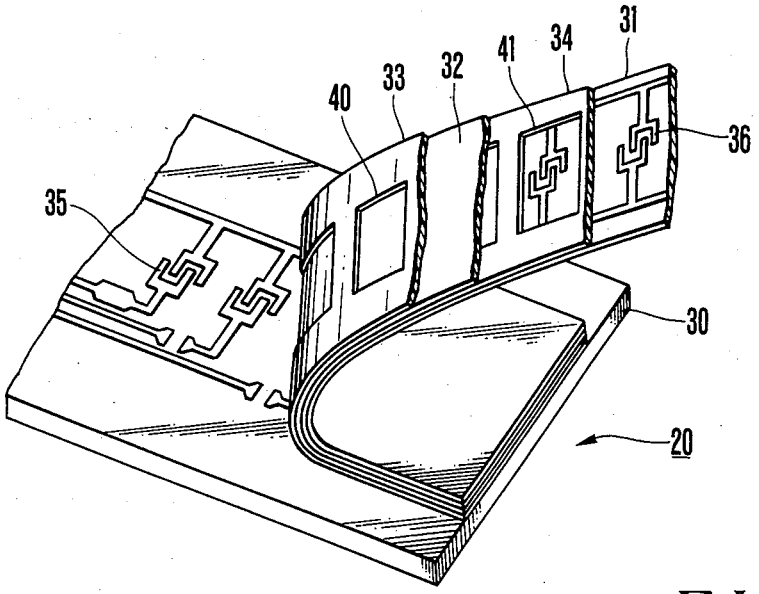
FIG. 6 is a perspective view of a keyboard switch apparatus (partially peeled) according to still another embodiment of the present invention.

FIG. 6 is a perspective view of a keyboard switch apparatus (partially peeled) according to still another embodiment of the present invention. In this embodiment, a first layer 30 comprises a normal printed circuit board, and a third layer 32 is made of conductive rubber. In this case, since the third layer 32 is a conductor, the conductors 37 and 38 in FIG. 1 need not be formed.

Figure 7:
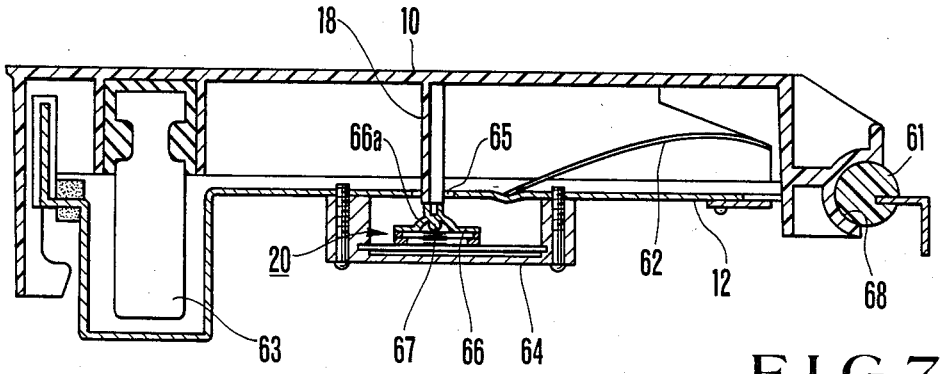
FIG. 7 is a sectional view of a keyboard unit according to still another embodiment of the present invention.

FIG. 7 is a sectional view of a keyboard unit according to still another embodiment of the present invention. Referring to FIG. 7, a white key 10 (the same as a black key) can be vertically pivoted since a fixed shaft disposed in a keyboard frame 12 is engaged with a semicircular recess 68 formed at the rear end face of the key 10. The key 10 is urged upward by a leaf spring 62. A weight 63 is mounted on the lower surface of the front end portion of the white key 10 so as to provide key touch similar to the piano.

A keyboard switch apparatus 20 is arranged at the central portion of the lower surface of the keyboard frame 12 through a switch mounting member 64 corresponding to an actuator 18 of the white key 10. The actuator 18 has a straight shape and its lower end portion extends in a through hole 65 formed in the keyboard frame 12. An inverted U-shaped elastic switch press member 66 is arranged at the lower end of the actuator 18. The switch press member 66 is formed integrally with the actuator 18 in accordance with outsert forming. The lower surface of the switch press member 66 is in contact with the upper surface of the keyboard switch apparatus 20. A projection 67 suspends integrally from the central portion of the inner surface of a dome **66*a* expanding upward. The projection 67 urges the second layer of the keyboard switch apparatus 20 upon key depression. The structure of the keyboard switch apparatus may be the same as that in FIG. 1 or in FIGS. 5 and 6**.

Other arrangements of the apparatus of FIG. 7 are substantially the same as those of FIG. 2.

Figure 8:
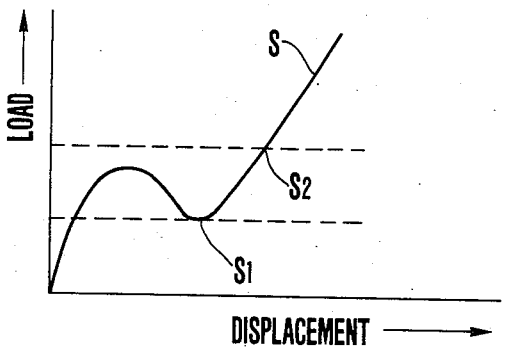
FIG. 8 is a graph showing the relationship between the load of an actuator and its displacement when a switch press member is used.

When the actuator 18 is moved downward upon depression of a key, the dome **66*a* of the switch press member 66 is gradually squeezed. In this case, a restoration force of the dome 66*a* acts on the actuator 18. When the dome 66*a* is elastically deformed by a certain extent, the dome 66*a* is buckled, so that the restoration force is minimized. Therefore, the relationship between the load of the actuator 18 and its displacement is given by a curve S in FIG. 8. When make points of first and second normally open switches A and B of the keyboard switch apparatus 20 are plotted at points S1 and S2 on the curve S, displacements (times required for making the switches A and B) of the actuator 18 are different from each other. In this embodiment, a difference between the times requiring performing make of the first and second normally open switches A and B and a difference between displacement times of the actuator 18** are used to perform sound production control in accordance with the key depression speed.

Figure 9:
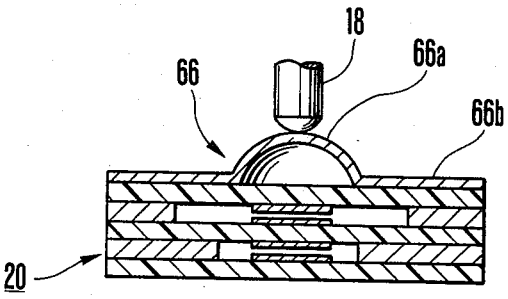
FIG. 9 is a sectional view showing another arrangement of the switch press member.

FIG. 9 is a sectional view showing another arrangement of the switch press member. A switch press member 66 consisting of a dome **66*a* and a base 66*b* formed integrally around the dome 66*a* is located in tight contact with the upper surface of the keyboard switch apparatus 20. The dome 66*a* is urged by the actuator 18 and is elastically deformed. In this case, the interior of the dome 66*a* is air-tightly sealed. When the dome 66*a* is squeezed upon depression of the actuator 18, an internal pressure increases and acts on the keyboard switch apparatus 20**.

Figure 10:
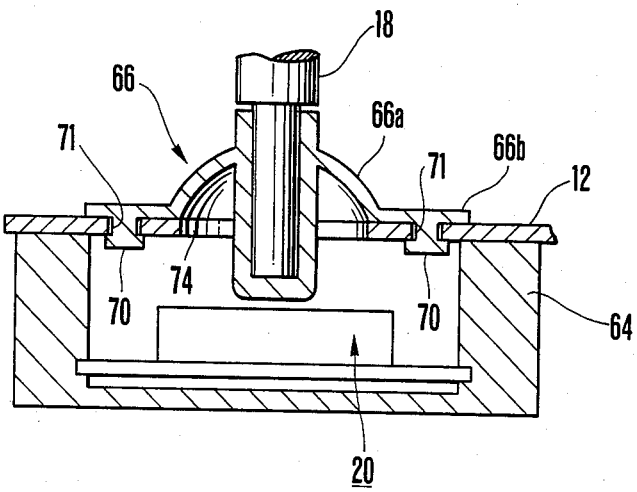
FIG. 10 is a sectional view showing still another arrangement of the switch press member.

FIG. 10 shows still another arrangement of the switch press member. A switch press member 66 is formed integrally with a keyboard frame 12 in accordance with outsert molding technique. Engaging projections 70 are formed on the lower surface of a base **66*b* of the switch member 66. The engaging projections 70 are formed to extend in engaging holes 71 formed in the keyboard frame 12, respectively, thereby bringing the press member 66 into tight contact with the upper surface of the keyboard frame 12. The press member 66 has a dome 66*a* expanding upward. A cylindrical portion 73 with a bottom which extends downward at the center of the dome 66*a* is inserted in a through hole 74 formed in the keyboard frame 12. The lower surface of the cylindrical portion 73 is located near or is in light contact with the keyboard switch apparatus 20. The top of the dome 66*a* is engaged with the distal end of the actuator 18 or is fitted inside the cylindrical member 73. In this manner, outsert forming simplifies the manufacture of the press member 66. It should be noted that the keyboard switch apparatus is fixed by a proper means in the recess of the member 64** suspending from the keyboard frame.

The present invention is not limited to the particular embodiments described above. Various changes and modifications may be made within the spirit and scope of the invention. For example, the conductors 36 and 37 shown in FIG. 1 may be formed by pattern printing in place of carbon printing. Similarly, the conductors 35 and 38 may be formed by carbon printing in place of pattern printing.

In the embodiments shown in FIG. 1 and FIGS. 5A, 5B and 5C, the time required for closing the second normally open switch B is set to be longer than that for the first normally open switch A. However, the closing time for the switch B may be set to be shorter than that for the switch A. Furthermore, the spacer members 33 and 34 need not be independently formed, and the thickness of the first, second or third layer 30, 31 or 32 may be large.

According to the present invention as described above, there is provided a keyboard switch apparatus comprising: the first layer, the second elastic layer, the third elastic layer interposed between the first and second layers through spacer members, a first switch consisting of the conductors formed on the opposite surfaces of the second and third layers, and a second switch consisting of the conductors formed on the opposite surfaces of the first and third layers, the second layer being elastically deformed by an actuator upon depression of a key, thereby sequentially operating the first and second switches. The keyboard switch apparatus has a simple structure and can be easily manufactured as compared with the conventional leaf switch. Furthermore, since the first and second switches are protected by the first and second layers, no dust is attached to the switches, and reliability and durability are improved.

What is claimed is:

1. A keyboard switch apparatus for an electronic musical instrument, comprising:

a first layer;

a second layer disposed at a distance from said first layer and having elasticity;

a third layer disposed between said first and second layers at a distance therefrom and having elasticity;

a first switch comprising conductors respectively formed on opposite surfaces of said second and third layers;

a second switch comprising conductors respectively formed on opposite surfaces of said first and third layers, said second and third layers being sequentially deformed by an actuator interlocked with a key depression to sequentially close said first and second switches, said first switch having a closing timing different from that of said second switch;

means for generating a signal corresponding to a key depression speed by detecting the difference between the timings of closure of said first and second switches; and means for generating a musical tone signal of an instrument in response to said signal.

2. An apparatus according to claim 1, which further comprises a first spacer member inserted between said first and third layers, and a second spacer member inserted between said second and third layers.

3. An apparatus according to claim 1, wherein a thickness of said second layer is different from that of said third layer, and the distance between said first and third layers is substantially the same as that between said second and third layers.

4. An apparatus according to claim 2, wherein a thickness of said first spacer member inserted between said first and third layers is different from that of said second spacer member inserted between said second and third layers.

5. An apparatus according to claim 2, wherein said first and second spacer members are arranged to form first and second closed spaces between said first and third layers and between said second and third layers, respectively, said first closed space having a sectional shape along a direction parallel to said first and third layers being different from that of said second closed space along a direction parallel to said second and third layers.

6. An apparatus according to claim 2, wherein each of said first and second spacer members comprises two spacers parallel in at least one direction, a distance between said two spacers of said first spacer member being different from that of said second spacer member.

7. An apparatus according to claim 1, wherein said second and third layers have different moduli of elasticity.

8. An apparatus according to claim 1, wherein an elastic switch press member having a dome portion extending upward is in contact with an upper surface of said second layer.

9. An apparatus according to claim 8, wherein a projection is formed on an inner surface portion of said dome portion of said switch press member so as to extend toward said second layer, said inner surface portion corresponding to said actuator.

10. An apparatus according to claim 8, wherein a cylindrical member is formed integrally with a top portion of said dome portion, said to portion corresponding to said actuator.

11. An apparatus according to claim 8, wherein said switch press member is formed by outsert molding on a frame located above said second layer at a distance therefrom, a projection extends downward, through an opening of said frame, from a central portion of an inner surface of said dome portion of said switch press member, a distal end of said projection being adapted to oppose said second layer.

12. A keyboard switch apparatus for an electronic musical instrument, comprising:

a first layer;

a second layer having elasticity;

a third having elasticity and arranged between said first and second layers;

a first spacer member arranged between said first and third layers;

a second spacer member arranged between said second and third layers;

a first switch comprising conductors respectively formed on opposite surfaces of said second and third layers;

a second switch comprising conductors respectively formed on opposite surfaces of said first and third switches, one of said conductors constituting said second switch being printed on an upper surface of said first layer, said first and second spacer member being made of sheet members each having an opening so as to allow switching of said conductors constituting said first and second switches, the other of said conductors constituting said second switch being printed on a lower surface of said second layer, remaining ones of said conductors consituting said first and second switches being printed on two surfaces of said third layer, said second and third layers being sequentially deformed by an actutator interlocked with key depression to sequentially close said first and second switches, and a time for closing said first switch being different from a time for closing said second switch;

means for generating a signal corresponding to a key depression speed by detecting the difference between the timings of closure of said first and second switches; and means for generating a musical tone signal of said instrument in response to said signal.

13. A keyboard switch apparatus for an electronic musical instrument, comprising:

a first layer;

a second layer having elasticity;

a third layer having elasticity and inserted between said first and second layers;

first and second spacer members for separating said first and second layers from each other;

a first switch comprising conductors respectively formed on opposite surfaces of said second and third layers;

a second switch comprising conductors respectively formed on opposite surfaces of said first and third layers, said second and third layers being sequentially deformed by an actuator interlocked with key depression to sequentially close said first and second switches, a time for closing said first switch being different from a time for closing said second switch;

means for generating a signal corresponding to a key depression speed by detecting the difference between the timings of closure of said first and second switches; and means for generating a musical tone signal of said instrument in response to said signal.

* * * * *